US010779078B2

(12) United States Patent
Schmidt

(10) Patent No.: US 10,779,078 B2
(45) Date of Patent: Sep. 15, 2020

(54) ACOUSTIC ENHANCEMENT APPARATUS FOR MOBILE DEVICES

(71) Applicant: Steve Schmidt, Elk Grove, CA (US)

(72) Inventor: Steve Schmidt, Elk Grove, CA (US)

( * ) Notice: Subject to any disclaimer, the term of this patent is extended or adjusted under 35 U.S.C. 154(b) by 0 days.

(21) Appl. No.: 15/712,594

(22) Filed: Sep. 22, 2017

(65) Prior Publication Data

US 2018/0084337 A1 Mar. 22, 2018

Related U.S. Application Data

(60) Provisional application No. 62/398,080, filed on Sep. 22, 2016.

(51) Int. Cl.
*H04R 1/34* (2006.01)

(52) U.S. Cl.
CPC ..... *H04R 1/345* (2013.01); *H04R 2499/11* (2013.01); *H04R 2499/15* (2013.01)

(58) Field of Classification Search
CPC ..... H04R 1/345; H04R 2499/11; H04R 2499/15; H04M 1/035
See application file for complete search history.

(56) References Cited

U.S. PATENT DOCUMENTS

2013/0045782 A1* 2/2013 Simmer ..... H04M 1/035 455/575.8
2013/0048413 A1* 2/2013 Patzer ..... H04M 1/04 181/199
2013/0301863 A1* 11/2013 Weaver, III ..... H04R 1/2853 381/334
2015/0027802 A1* 1/2015 Altschul ..... A45C 11/00 181/177
2015/0041245 A1* 2/2015 Smith ..... G10K 11/28 181/202

* cited by examiner

*Primary Examiner* — Sunita Joshi
(74) *Attorney, Agent, or Firm* — Innovation Capital Law Group, LLP; Vic Lin

(57) ABSTRACT

An acoustic enhancement device improves the built-in sound system of electronic devices with speakers, such as smart phones, tablets, laptops and the like. The acoustic enhancement device can channel sound waves toward a particular direction—toward the listener's ear—thereby resulting in more sound waves reaching the listener. The acoustic enhancement device can also boost the acoustic impedance of the speaking, resulting in a stronger, specific power or volume. With the device's unique shaped design, the narrow openings of the speaker holes are proportionately opened toward the wider end of the device, thereby reducing the effect of wave reflection and increasing the sound volume toward the listener's ear.

18 Claims, 3 Drawing Sheets

ACOUSTIC ENHANCEMENT APPARATUS FOR MOBILE DEVICES

CROSS-REFERENCE TO RELATED APPLICATIONS

This application claims the benefit of priority to U.S. Provisional Patent Application No. 62/398,080, filed Sep. 22, 2016, the contents of which are herein incorporated by reference.

BACKGROUND OF THE INVENTION

1. Field of the Invention

Embodiments of the invention relates generally to acoustic enhancement apparatus. More particularly, the invention relates to apparatus and methods for enhancing the built-in sound reinforcement system of electronic devices with speakers, such as mobile phones, tablet computers and laptop computers.

2. Description of Prior Art and Related Information

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The size and location of smart phone and tablet internal audio speakers make watching a video, using video conferencing or playback of an audio file less than desirable at best. Often it is hard to hear people cut short what they are doing or simply miss much of what is being reproduced out of original equipment manufacturer (OEM) speakers.

Normally, with a smart phone of tablet speaking system, the sound waves emanate from the bottom or top of the device and speaker downward to open air or upward away from the listener's required body part to hear—the human ear. In this scenario, the sound waves scatter in a dispersed direction, thereby reducing the amount of sound that the receiving person receives and hears. Also, sound waves are primarily being directed away from the listener's ears, not toward the ears.

Moreover, the vastness of the open air normally from a phone or tablet causes a larger area of reflection of the speaker's sound waves, resulting in a reduction of sound power.

Conventional devices have been introduced to improve the sound of portable electronic devices, such as smart phones. These devices, however, are often cumbersome, costly to make, have external clipping mechanisms that can be lost, can be easily broken, are aesthetically unsatisfactory, reduce the portability of the device, or can break off.

In view of the foregoing, there is a need for a subtle type of sound reinforcement system that can be used to augment, direct, reflect or reverberant sound, where the device can boost the acoustic impedance of OEM speakers of electronic devices and improve sound waves from OEM speakers by directing them toward the listener.

SUMMARY OF THE INVENTION

Embodiments of the present invention provide an acoustic enhancing device comprising a curved surface extending from a bottom portion of an electronic device, the curved surface extending outward and away from one or more speakers disposed on a side of the electronic device; and a terminus of the curved surface disposed a first distance away from the bottom portion of the electronic device and a second distance away from the one or more speakers, wherein the acoustic enhancing device has an opening directed upward in a direction toward a plane defined by a display screen of the electronic device.

Embodiments of the present invention further provide a case for an electronic device comprising one or more side members and a base portion for securing the electronic device therein; and an acoustic enhancing device including a curved surface extending from a bottom portion of an electronic device, the curved surface extending outward and away from one or more speakers disposed on a side of the electronic device, and a terminus of the curved surface disposed a first distance away from the bottom portion of the electronic device and a second distance away from the one or more speakers, wherein the acoustic enhancing device has an opening directed upward in a direction toward a plane defined by a display screen of the electronic device.

Embodiments of the present invention also provide a method for improving sound from an electronic device having at least one speaker comprising disposing a case on the electronic device; and positioning an acoustic enhancing device adjacent one or more speakers of the electronic device, the acoustic enhancing device including a curved surface extending from a bottom portion of an electronic device, the curved surface extending outward and away from one or more speakers disposed on a side of the electronic device; and a terminus of the curved surface disposed a first distance away from the bottom portion of the electronic device and a second distance away from the one or more speakers, wherein the acoustic enhancing device has an opening directed upward in a direction toward a plane defined by a display screen of the electronic device.

In some embodiments, the acoustic enhancing device has a curved surface that is a smooth, continuously curving surface.

In some embodiments, the terminus has a smoothly curved outer surface that curves downward toward the bottom portion of the electronic device.

In some embodiments, the second distance is selected to position the terminus from about 3 mm to about 12 mm away from the one or more speakers.

In some embodiments, the first distance is selected to position the terminus at a first height equal to or greater than a second height of the one or more speakers from the bottom portion of the electronic device.

In some embodiments, the electronic device is a portable electronic device, such as a smart phone, a tablet computer, a laptop computer, or the like.

In some embodiments, the acoustic enhancing device is formed integrally with a case for securing the electronic device.

These and other features, aspects and advantages of the present invention will become better understood with reference to the following drawings, description and claims.

BRIEF DESCRIPTION OF THE DRAWINGS

Some embodiments of the present invention are illustrated as an example and are not limited by the figures of the accompanying drawings, in which like references may indicate similar elements.

Figure 1:
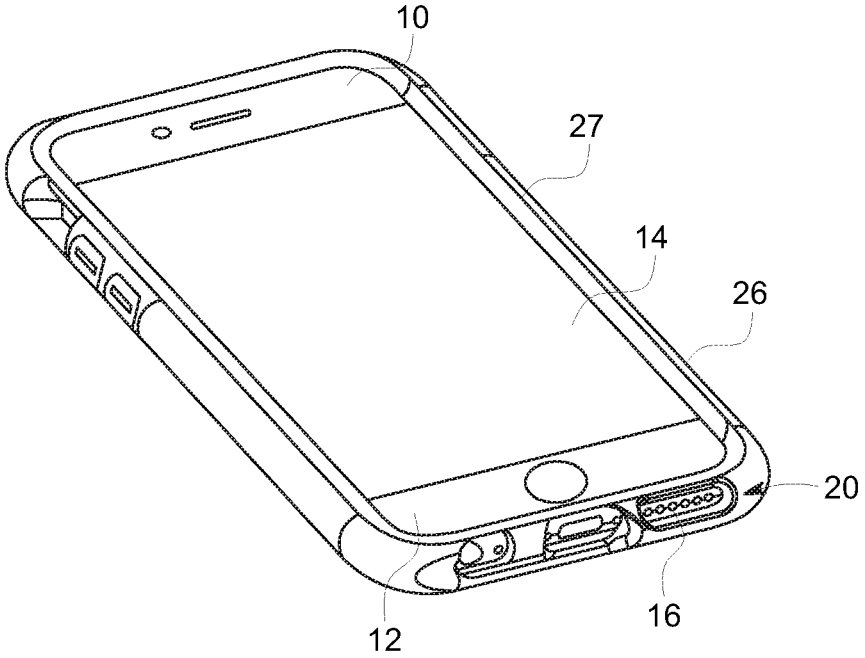
FIG. 1 illustrates a perspective view of an electronic device disposed in a case having an acoustic enhancement feature according to an exemplary embodiment of the present invention.

Unless otherwise indicated illustrations in the figures are not necessarily drawn to scale.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

Devices or system modules that are in at least general communication with each other need not be in continuous communication with each other, unless expressly specified otherwise. In addition, devices or system modules that are in at least general communication with each other may communicate directly or indirectly through one or more intermediaries.

As is well known to those skilled in the art, many careful considerations and compromises typically must be made when designing for the optimal configuration of a commercial implementation of any system, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Broadly, embodiments of the present invention provide an acoustic enhancement device that improves the built-in sound system of electronic devices with speakers, such as smart phones, tablets, laptops and the like. The acoustic enhancement device can channel sound waves toward a particular direction—toward the listener's ear—thereby resulting in more sound waves reaching the listener. The acoustic enhancement device can also boost the acoustic impedance of the speaking, resulting in a stronger, specific power or volume. With the device's unique shaped design, the narrow openings of the speaker holes are proportionately opened toward the wider end of the device, thereby reducing the effect of wave reflection and increasing the sound volume toward the listener's ear.

Figure 2:
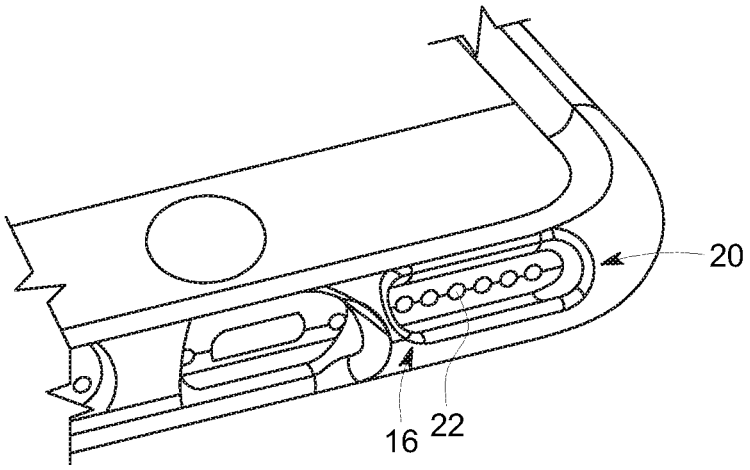
FIG. 2 illustrates a close-up perspective view of a speaker of the electronic device having the acoustic enhancement feature of FIG. 1.
Figure 3:
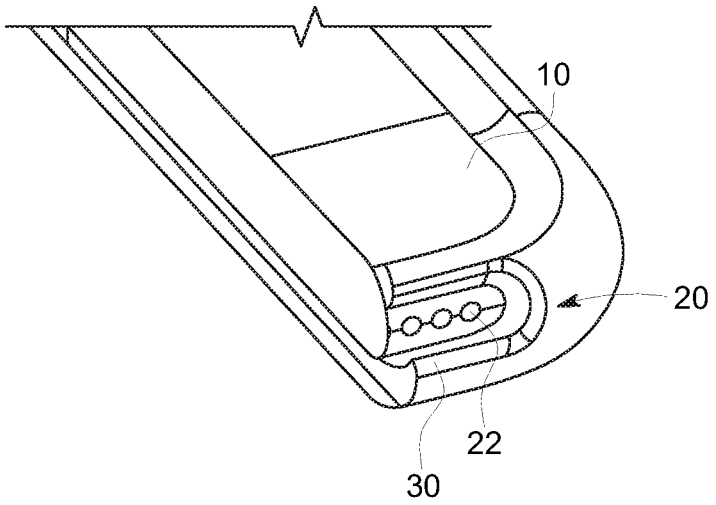
FIG. 3 illustrates a cross-sectional perspective view of the speaker of the electronic device and the acoustic enhancement feature of FIG. 1.
Figure 4:
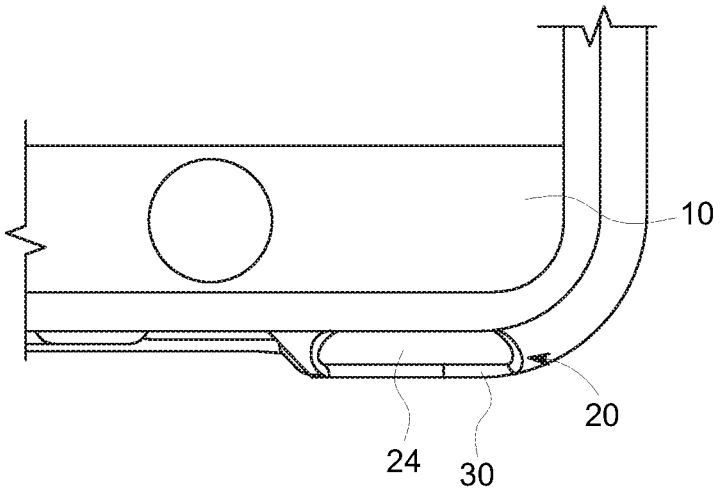
FIG. 4 illustrates a close-up top view of the acoustic enhancement feature of FIG. 1.
Figure 5:
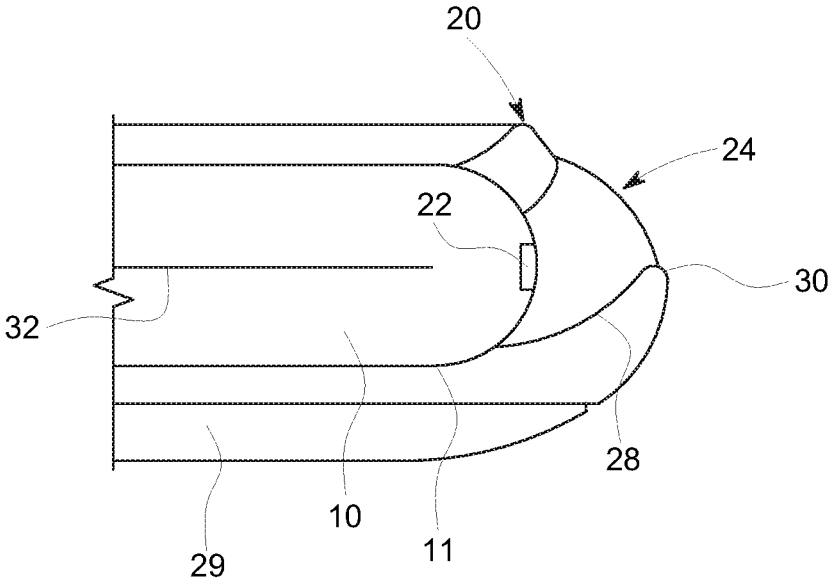
FIG. 5 illustrates a side cross-sectional view of the speaker of the electronic device having the acoustic enhancement feature of FIG. 1.

Referring to FIGS. 1 through 5, an electronic device 10 can have a user facing side 12 that typically includes a display screen 14, for example. When a user is looking at the display screen 14 and sound is being played out of the speakers 16, this sound is typically directed orthogonally away from the user facing side 12. The result is that the sound from the speakers 16 is often directed away from the user's ears.

An acoustic enhancing device 20, or simply device 20, can be disposed adjacent the speakers 16 of the electronic device 10 to improve the sound being delivered from the electronic device 10. Without being limited to any particular theory, the sound improvement may be achieved via two different mechanisms. First, the acoustic enhancing device 20 can channel sound waves toward the user, thereby resulting in more sound waves reaching the listener. Second, the acoustic enhancing device 20 can boost the acoustic impedance of the speaker, resulting in stronger specific power or volume. The device 20 can proportionately open the narrow opening of the speaker holes 22 toward the wider end or opening 24 of the device 20.

The acoustic enhancing device 20 may extend from a bottom portion 11 of the electronic device 10 and curve upward and away from the speaker holes 22. Typically, the curve 28 is a continuous and smooth curve that extends outward from about 2 mm to about 20 mm, typically from about 3 mm to about 12 mm, away from the speaker holes 22. The curve 28 may extend upward to a terminus 30 that is typically located at or near a lengthwise central axis 32 of the electronic device 10. In some embodiments, the terminus 30 may be located above (that is, toward the plane of the user facing side 12) the lengthwise central axis 32 of the electronic device 10. Typically, the terminus 30 may be positioned at a height from the bottom portion 11 of the electronic device 10 that is equal to or greater than the height of the speaker holes 22 from the bottom portion 11 of the electronic device 10. In some embodiments, the terminus 30 may smoothly curve around and back toward the plane of the bottom portion 11 of the electronic device 10.

The acoustic enhancing device 20 may be formed as part of a case 26 for the electronic device 10. The case 26 can include one or more side members 27 extending from a base member 29 for securing the electronic device 10 therein. In this embodiment, the case 26 may be disposed about the electronic device 10 in various manners, as may be known in the art. The case 26 may include the acoustic enhancing device 20 at the location of the speaker openings on one or more edges of the electronic device 10. While the Figures show a single set of speaking holes 22 on one side face of the electronic device, acoustic enhancing device 20 may be disposed on one or more sides of the electronic device, should the device include multiple sets of speaker holes 22 on various side faces of the electronic device.

In some embodiments, the acoustic enhancing device 20 may be formed as part of a skin, partial case, or other similar attachment to the electronic device.

One decibel is close to the just noticeable difference (JND) for sound levels. As discussed below, the acoustic enhancing device of the present invention achieves results far greater than the JND. One hundred percent of 100 people surveyed without severe hearing loss blindly observed, without a doubt, that the acoustic enhancing device of the present invention provides a louder, clearer sound as compared to OEM speaker sound.

When playing music on an iPhone® protected using a case having the acoustic enhancing device of the present invention, an average overall increase in decibel level of +3.9 dB was found compared to playing music on an iPhone® with no case protection. This equals a sound intensity factor of about 2.45 times.

In one study, the song "Beat It" by Michael Jackson was played on an iPhone®. Frequency analysis images were taken from five points across the duration of the song and the overall decibel peak levels were taken from these five points. A microphone was placed 12 inches from the center display of the electronic device. In this study, an average decibel increase of +2.52 dB was found in testing frequencies of 300 hz, 600 hz, 800 hz, 1 khz, 3 khz, 6 khz, 8 khz, 10 khz, 12 khz, 15 khz and 18 khz at song time points 17 s, 48 s, 1 m 56 s, 2 m 57 s and 4 m 4 s. For low frequencies of less than 1 khz, an average decibel increase of +2.06 dB was observed. For high frequencies greater than 1 khz, an average decibel increase of +2.83 dB was observed.

Thus, the acoustic enhancing device can boost the acoustic impedance of OEM speakers of electronic devices, resulting in stronger specific power or volume. Moreover, the acoustic enhancing device can improve the sound waves from OEM speakers by directing the sound waves toward the user through its crescent shaped design.

The acoustic enhancing device of the present invention has a small size that is not cumbersome or that sticks out to scratch or catch objects. The device can be easily manufactured without requiring external clipping mechanisms that can be lost or mounts that can add extra expense.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a sub combination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. An acoustic enhancing device comprising:

a curved surface extending from a bottom portion of an electronic device, the curved surface extending outward and away from one or more speakers disposed on a side of the electronic device, the curved surface having a curved surface width approximating a speaker width of each of the one or more speakers, the curved surface positioned exterior to an outer perimeter of the electronic device; and a terminus of the curved surface disposed a fixed first distance away from the bottom portion of the electronic device and a fixed second distance away from the one or more speakers, the speaker of the electronic device and the terminus of curved surface defining a first plane that is coplanar with a second plane of a front face of the electronic device, wherein the acoustic enhancing device has an opening directed upward in a direction toward a plane defined by a display screen of the electronic device, the opening defined between the outer perimeter of the electronic device and the terminus of the curved surface.

2. The acoustic enhancing device of claim 1, wherein the curved surface is a smooth, continuously curving surface.

3. The acoustic enhancing device of claim 1, wherein the terminus has a smoothly curved outer surface that curves downward toward the bottom portion of the electronic device.

4. The acoustic enhancing device of claim 1, wherein the second distance is selected to position the terminus from about 3 mm to about 12 mm away from the one or more speakers.

5. The acoustic enhancing device of claim 1, wherein the first distance is selected to position the terminus at a first height equal to or greater than a second height of the one or more speakers from the bottom portion of the electronic device.

6. The acoustic enhancing device of claim 1, wherein the electronic device is a portable electronic device.

7. The acoustic enhancing device of claim 1, wherein the acoustic enhancing device is formed integrally with a case for securing the electronic device.

8. A case for an electronic device comprising:

one or more side members and a base portion for securing the electronic device therein; and an acoustic enhancing device including:

a curved surface extending from and integral with the base portion of the case, the curved surface extending outward and away from one or more speakers disposed on a side of the electronic device, the curved surface integral to and fixed with the one or more side members, the curved surface positioned exterior to a perimeter of the electronic device;

a terminus of the curved surface disposed a first distance away from the bottom portion of the electronic device and a second distance away from the one or more speakers, the speaker of the electronic device and the terminus of curved surface defining a first plane that is coplanar with a second plane of a front face of the electronic device, wherein the acoustic enhancing device has an opening directed upward in a direction toward a plane defined by a display screen of the electronic device, the opening defined between the outer perimeter of the electronic device and the terminus of the curved surface.

9. The case of claim 8, wherein the curved surface is a smooth, continuously curving surface.

10. The case of claim 8, wherein the terminus has a smoothly curved outer surface that curves downward toward the bottom portion of the electronic device.

11. The case of claim 8, wherein the second distance is selected to position the terminus from about 3 mm to about 12 mm away from the one or more speakers.

12. The case of claim 8, wherein the first distance is selected to position the terminus at a first height equal to or greater than a second height of the one or more speakers from the bottom portion of the electronic device.

13. The case of claim 8, wherein the electronic device is a portable electronic device.

14. A method for improving sound from an electronic device having at least one speaker, comprising:

disposing a case on the electronic device; and positioning an acoustic enhancing device adjacent one or more speakers of the electronic device, the acoustic enhancing device including a curved surface extending from and integral with a base portion of the case, the curved surface integral to and fixed with one or more side members of the case, the curved surface extending outward and away from one or more speakers disposed on a side of the electronic device, the curved surface positioned exterior to a perimeter of the electronic device; and a terminus of the curved surface disposed a first distance away from the bottom portion of the electronic device and a second distance away from the one or more speakers, the speaker of the electronic device and the terminus of curved surface defining a first plane that is coplanar with a second plane of a front face of the electronic device, wherein the acoustic enhancing device has an opening directed upward in a direction toward a plane defined by a display screen of the electronic device, the opening defined between the outer perimeter of the electronic device and the terminus of the curved surface.

15. The method of claim 14, wherein the curved surface is a smooth, continuously curving surface.

16. The method of claim 14, wherein the terminus has a smoothly curved outer surface that curves downward toward the bottom portion of the electronic device.

17. The method of claim 14, further comprising positioning the terminus from about 3 mm to about 12 mm away from the one or more speakers.

18. The method of claim 14, further comprising positioning the terminus at a first height equal to or greater than a second height of the one or more speakers from the bottom portion of the electronic device.

* * * * *